US005781085A

United States Patent [19]

Harrison

[11] Patent Number: 5,781,085

[45] Date of Patent: Jul. 14, 1998

[54] POLARITY REVERSAL NETWORK

[75] Inventor: William H. Harrison, Payson, Ariz.

[73] Assignee: L-3 Communications Narda Microwave West, Rancho Cordova, Calif.

[21] Appl. No.: 758,051

[22] Filed: Nov. 27, 1996

[51] Int. Cl.[6] ..... H01P 1/20; H01P 1/205

[52] U.S. Cl. ..... 333/202; 333/203; 333/212

[58] Field of Search ..... 333/202, 203, 333/208, 201, 212, 219.1, 227–233, 235

[56] References Cited

U.S. PATENT DOCUMENTS

| | | | |
|---|---|---|---|
| 2,607,017 | 8/1952 | Bruck | 315/5 |
| 2,698,923 | 1/1955 | Edson | 333/83 |
| 2,954,536 | 9/1960 | Muller | 333/212 X |
| 3,737,816 | 6/1973 | Honicke | 333/209 |
| 3,899,759 | 8/1975 | Hines et al. | 333/212 |
| 4,138,652 | 2/1979 | Nishikawa et al. | 333/202 |
| 4,167,713 | 9/1979 | Pfitzenmaier | 333/212 |
| 4,216,448 | 8/1980 | Kasuga et al. | 333/203 |
| 4,246,555 | 1/1981 | Williams | 333/212 X |
| 4,275,369 | 6/1981 | Sekiuguchi | 333/209 |
| 4,291,288 | 9/1981 | Young et al. | 333/212 |
| 4,453,146 | 6/1984 | Fiedziuszko | 333/212 |
| 4,477,785 | 10/1984 | Atia | 333/202 |
| 4,575,699 | 3/1986 | Lockwood | 333/219 |
| 4,673,895 | 6/1987 | Tadachi et al. | 331/99 |
| 4,686,496 | 8/1987 | Syrett et al. | 333/202 |
| 4,725,797 | 2/1988 | Thompson et al. | 333/212 |
| 4,734,647 | 3/1988 | Yoshimura | 324/318 |
| 4,746,883 | 5/1988 | Sauvage et al. | 333/202 |
| 4,757,289 | 7/1988 | Kosugi et al. | 333/209 |
| 4,761,625 | 8/1988 | Sharma | 333/209 |
| 4,862,122 | 8/1989 | Blair, Jr. et al. | 333/202 |
| 4,890,079 | 12/1989 | Sasaki | 333/206 |
| 5,083,102 | 1/1992 | Zaki | 333/212 |
| 5,220,300 | 6/1993 | Snyder | 333/210 |
| 5,239,280 | 8/1993 | Noguchi et al. | 333/206 |
| 5,268,659 | 12/1993 | Zaki et al. | 333/209 |
| 5,373,270 | 12/1994 | Blair et al. | 333/202 |
| 5,410,284 | 4/1995 | Jachowski | 333/203 X |
| 5,604,471 | 2/1997 | Rattila et al. | 333/202 |
| 5,608,363 | 3/1997 | Cameron et al. | 333/219.1 X |

FOREIGN PATENT DOCUMENTS

| | | | |
|---|---|---|---|
| 0101369 | 2/1984 | European Pat. Off. | 333/212 |
| 60-112301A | 11/1983 | Japan . | |
| 0302601 | 12/1988 | Japan | 333/202 |
| 0260901 | 10/1989 | Japan | 333/202 |

OTHER PUBLICATIONS

"Dielectric Resonators", D. Kajfez et al., Artech House Inc., Library of Congree 86–70447, pp.1–8., 1995 no month.

Radio Engineers Handbook, F.E. Terman, Stanford University (McGraw–Hill), pp. 162–164, 1943 no month.

*Primary Examiner*—Seungsook Ham

*Attorney, Agent, or Firm*—Perman & Green, LLP

[57] ABSTRACT

A polarity reversal network is provided for a microwave filter that includes a plurality of resonators. The polarity reversal network has a magnetic coupling device that is positioned within an iris of the filter between a pair of the resonators. The coupling device is tunable to adjust its resonant frequency and is used to magnetically couple a signal from a first one of the pair of resonators to a second one of the pair of resonators. The coupling device also reverses the polarity of the magnetically-coupled signal upon the resonant frequency being tuned below a passband frequency of the microwave filter. As a result, the polarity of the signal resembles that of a capacitively-coupled signal.

28 Claims, 9 Drawing Sheets

POLARITY REVERSAL NETWORK

FIELD OF THE INVENTION

This invention relates to microwave filters and, in particular, this invention relates to a polarity reversal network for a microwave filter.

BACKGROUND OF THE INVENTION

The selectivity of a bandpass filter can be improved by employing nulling circuitry to increase the slope of filter skirts adjacent to the filter's passband. By example, elliptical filters utilize parallel resonant circuits that are placed in series between bandpass resonators to produce multiple nulls at desired stopband frequencies. In this type of filter, a predetermined level of coupling is provided in the passband with the parallel circuit. The resonant frequency of the parallel circuit is chosen to provide a minimum level of coupling (null) at desired stopband frequencies.

Another known technique for enabling a microwave filter to produce nulls at desired stopband frequencies involves coupling between non-adjacent resonators of the filter. This can be achieved using, for example, a coupling structure that provides cross-coupling between these non-adjacent resonators to introduce a signal of a specific amplitude and phase between these resonators. This cross-coupling technique has been employed extensively in conventional combline filters where it is very convenient to insert small capacitive probes into the high impedance region of the specific resonators employed in the filter's null-producing circuitry. The positions of these probes within the high impedance region of the resonator determines an amount of capacitive cross-coupling provided between the resonators, and can be adjusted to produce null(s) at desired frequency(s) in the filter's stopband.

It is known in the art that dielectric resonators (DRs) exhibit superior performance over conventional combline or cavity-type filters employing metallic resonators. Specifically, DRs exhibit higher unloaded Q (Qu) values, and a resulting lower passband insertion loss. As a result, the use of DRs has become widespread, particularly in highly selective filters where passband loss can be excessively high. Recently this has become of even greater significance owing to a need to minimize interference between very closely-spaced (Federal Communications Commission defined) cellular telephone channels.

Unlike combline resonators, DRs exhibit little external electric fields. That is, the electric field of a dielectric resonator which is cylindrical in shape, is substantially contained within the resonator in the desired mode of operation. Thus, unlike combline filters, negligible coupling is provided by the electric fields of adjacent dielectric resonators of a DR filter. In contrast, the magnetic fields yielded by dielectric resonators extend beyond the confines of the resonator structures and into the surrounding cavity of the filter. As such, the magnetic fields can be used to provide magnetic coupling between adjacent resonators.

FIG. 4 illustrates a top cross-sectional view of an exemplary conventional structure 27 which is referred to in order to describe the manner in which magnetic coupling is provided between a pair of DRs labeled (A) and (B). The structure 27 may form a portion of, by example, a DR filter. As can be appreciated, when a microwave signal is input into connector (C1) of structure 27, it is coupled to the DR (A) through an inductive loop (La) via a mutual magnetic field that is present between the loop (La) and the DR (A). The signal is then coupled to the DR (B) via mutual magnetic fields appearing between the DR (A) and the DR (B). Thereafter, the signal is coupled to an output inductive loop (Lb) via a mutual magnetic field present between the DR (B) and the output loop (Lb). From the loop (Lb), the signal is then coupled to the connector (C2). The magnetic fields are not shown in FIG. 4. However, the manner in which the magnetic field of each dielectric resonator (A) and (B) extends around the respective DR is similar to the manner in which magnetic field (H) extends around the DR shown in FIG. 14.

As described above, the electric fields of DRs are contained substantially within the DR structures. In actuality, however, a small portion of these electric fields extend beyond the confines of the resonators and into the surrounding cavity C3. These electric fields are represented by the designation "E" in FIG. 4. The electric field (E) of each DR encircles the resonator and extends in a plane that is normal to the plane in which the magnetic field of the resonator extends. An exemplary equivalent circuit of a pair of mutually coupled resonant circuits is shown in FIG. 13*a*. The mutual coupling that is provided between the resonant circuits is represented by the label "Meq".

FIG. 5 illustrates an example of a known structure 28 which is similar to that of FIG. 4, and which also includes a wire or strap loop (L) and partitions (W1) and (W2) that are separated by a slot or iris (I). Two resonators (A) and (B) are separated by the partitions (W1) and (W2). The loop (L) protrudes through the slot (I) and is grounded at both of its ends, forming a rectangle. With the loop (L) connected as such, the loop (L) provides a level of coupling that is in addition to the level of proximity coupling provided between the resonators (A) and (B) via the slot. The coupling provided via the loop (L) has the same "polarity" as that provided via the slot (I). If the slot width is increased, the coupling provided via the slot (I) increases proportionally. Similarly, if the loop dimensions are increased so that portions of the loop (L) become in closer proximity to the resonators (A) and (B), the coupling provided by the loop (L) also increases proportionally, and thus further adds to the slot magnetic coupling.

In order to produce a null at a desired frequency using cross-coupling techniques within DR filters, it is necessary to introduce a phase or polarity reversal between resonators in the filter using a magnetic coupling mechanism. Conventional techniques have accomplished this using, for example, intricate wire or strap loops where one of the loops is inverted.

FIG. 6 shows a structure 29 that is similar to that of FIG. 5, except that a loop (Li) is provided for reversing the polarity of a signal being coupled between the two resonators (A) and (B). The loop (Li) includes two half-loops having terminations that are grounded to the respective partitions (W1) and (W2) on opposite sides of the slot (I). The loop-coupled portion of the mutual coupling provided between the resonator (A) and (B) is out of phase with that produced by the slot (I), and thus subtracts from this coupling. If the slot width is small, its contribution to the overall coupling is negligible. If the dimensions of the loop (Li) are sufficiently large, the coupling the loop (Li) provides becomes greater than that provided by the slot (I). Because the two halves of the loop (Li) are grounded to the partitions (W1) and (W2) on opposite sides of the slot (I), the coupling provided between resonators (A) and (B) has an opposite polarity as compared to the coupling provided between resonators (A) and (B) shown in FIG. 5. In this manner, the loop (Li) provides a phase-reversed coupling.

At least some prior art devices used for providing polarity reversal appear to be simple in structure, when viewed from a superficial perspective. However, as can be appreciated by those skilled in the art, the structures of these devices can actually be quite intricate. Also, these devices can be difficult to tune and adjust, and thus can increase manufacturing costs.

OBJECTS OF THE INVENTION

It is the first object of this invention to provide a polarity reversal network for electromagnetically coupling a signal between (DRs) dielectric resonators of a microwave filter in a manner which causes the signal to exhibit a reversed polarity with respect to a signal that is inductively coupled between the resonators.

It is another object of this invention to provide a polarity reversal network that is usable in a microwave filter for enabling the filter to exhibit stopband nulls.

It is a further object of this invention to provide a polarity reversal network for a microwave filter which causes the filter to exhibit a passband having steep skirts.

Further objectives and advantages of this invention will become apparent from a consideration of the drawings and ensuing description.

SUMMARY OF THE INVENTION

The forgoing and other problems are overcome and the objects of the invention are realized by a polarity reversal network, and by a method for coupling a signal between a pair of resonators of a microwave filter. The polarity reversal network comprises an adjusting screw or post that extends through and is threadedly engaged with a wall of a housing of the filter. A portion of the screw extends into an iris of the filter. The iris is located adjacent to the pair of resonators. The screw extends along an axis that is normal to a plane in which magnetic fields of the pair of resonators appear.

The screw may be rotated in a clockwise or counter-clockwise direction to adjust the distance by which the screw extends into the iris relative to an inner surface of the housing wall. As penetration is increased, a level of coupling provided between the resonators by the screw increases. This increased coupling adds to proximity inductive coupling being provided between the resonators via the iris, as both couplings are in phase. However, as penetration of the screw into the iris is further increased, the screw's resonant frequency approaches a frequency of the filter's passband, and then eventually passes through this passband frequency. At the passband frequency, the screw behaves as one of the resonators of the filter and produces a high level of coupling. However, as penetration of the screw is further increased, the screw's resonant frequency becomes tuned to a lower frequency than that of the passband. Upon turning the screw to a resonant frequency that is below the frequency of the passband, the polarity of a signal coupled via the screw rotates to a polarity which is opposite that of a signal that is inductively coupled between resonators of the filter. As long as the screw's resonant frequency is tuned below the frequency of the passband, signals that are coupled via the screw maintain this opposite polarity. The coupling level provided by the screw is dependent upon the proximity of its resonant frequency to the frequency of the passband. Thus, a desired coupling level can be achieved by adjustment of the screw until the desired results are observed.

In accordance with one embodiment of the invention, the polarity reversal network may be provided in a microwave filter that comprises a plurality of dielectric resonators. In accordance with another embodiment of the invention, the polarity reversal network may be employed in a microwave filter which comprises a plurality of combline resonators or cavity resonators. The size of the filter cavity, the positions of the resonators within the cavity, the iris dimensions, and the length of the screw/post determine the amplitude and phase of the coupling provided between the resonators.

The polarity reversal network provides a convenient mechanism for providing a reversed-polarity magnetic coupling between resonators of a filter in order to enable the filter to exhibit increased skirt selectivity and stopband nulls.

The polarity reversal network may be located within the filter so as to provide cross-coupling within the filter or to simply produce a polarity-reversed coupling between selected resonators within the filter. When the polarity reversal network is not used to provide cross-coupling, cross-coupling is established via an iris using normal magnetic coupling. In other words, cross-coupling may be provided using either the polarity reversal network or a typical iris, so long as both cross-coupling and a polarity-reversed coupling are provided in the filter in cases wherein it is desired that the filter exhibit one or more stopband nulls.

In accordance with a further aspect of the invention, a reactance cancellation circuit is provided. The reactance cancellation circuit compensates for an increase in the resonant frequencies of DRs resulting from the presence of the polarity reversal network within the filter. This is especially important in DR filters since dielectric resonators are not typically tuned over a significant frequency range. Excessive tuning can alter the unloaded Q of DRs, and can result in increased insertion loss. As such, it is desirable to tune all of the resonators in the filter only over a very limited frequency range. One technique for tuning a DR filter to compensate for an increase in its resonant frequency due to the presence of the polarity reversal network involves increasing the size of the two resonators that are adjacent to the polarity reversal network. However, this is not desirable from a manufacturing perspective and also makes it more difficult to tune the filters.

BRIEF DESCRIPTION OF THE DRAWINGS

The above set forth and other features of the invention are made more apparent in the ensuing description of the invention hen read in conjunction with the attached drawings, wherein.

DETAILED DESCRIPTION OF THE INVENTION

The present invention is directed to a polarity reversal network for microwave filters, and to microwave filters which provide a response that is similar to that of an inductively-coupled lumped element filter employing L-C elements. The filter includes the polarity reversal network to provide magnetic coupling between a selected pair of resonators of the filters. The magnetic coupling provided by the polarity reversal network is similar to coupling that would be provided if, for example, capacitive coupling were used between the resonators, although the filters do not have a similar frequency response as a filter which employs capacitive coupling. The polarity reversal network may be employed at locations within the filters that enable the filters to exhibit stopband nulls and sharply-sloped stopband skirts. Techniques for selecting locations within a filter where it is necessary for inductive and capacitive couplings to occur in order for the filter to yield these characteristics are known in the art.

The polarity reversal network of the present invention has a simpler structure than conventional devices that attempt to achieve an equivalent capacitive coupling to improve filter response characteristics. The polarity reversal network may be employed to provide an equivalent capacitive coupling between any pair of adjacent resonators of a filter, so long as these resonators are located within a path that causes the filter to exhibit stopband nulls. This will be further described below. The invention may be further understood in view of the various embodiments of the invention to be described below.

Figure 1:
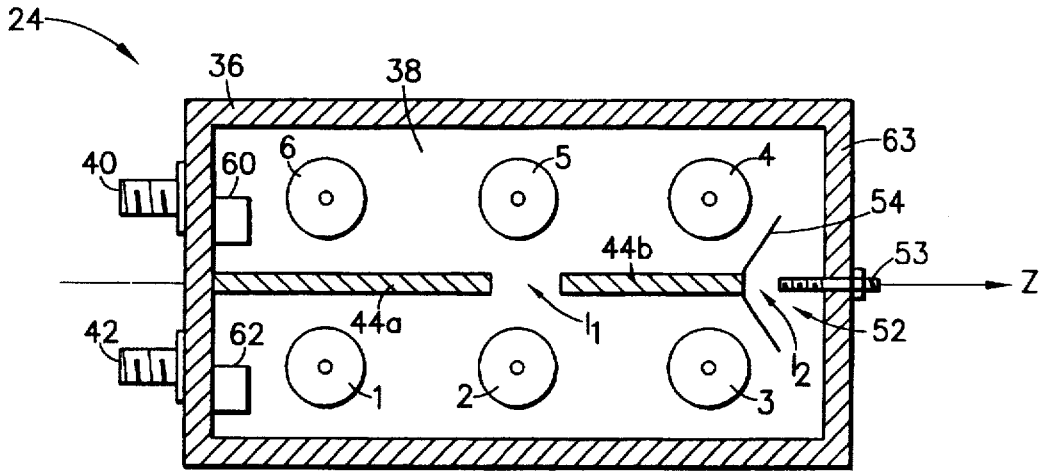
FIG. 1 shows a top view of a cross section of a DR filter that includes six DRs, a polarity reversal network, and a reactance cancellation circuit constructed in accordance with the invention.

FIG. 1 illustrates a cross section of a dielectric resonator (DR) filter 24 that is constructed in accordance with one embodiment of the invention. The DR filter 24 comprises a housing 36, first and second walls 44*a* and 44*b*, respectively, first and second connectors 40 and 42, respectively, dielectric resonators 1–6, couplers 60 and 62, a polarity reversal network or circuit 52, and a reactance cancellation circuit 54. Coupler 60 is used to couple a signal from the first connector 40 to resonator 6, and coupler 62 is used to couple a signal from the second connector 42 to the resonator 1. The first and second walls 44*a* and 44*b* are separated from one another at respective adjacent ends thereof by an iris ($I_1$). Another end of the second wall 44*b* is separated from a side wall 63 of the housing 36 by an iris ($I_2$). The polarity reversal network 52 and the reactance cancellation circuit 54 are located adjacent to the resonators 3 and 4. The manner in which these devices function will be described below.

Figure 14:
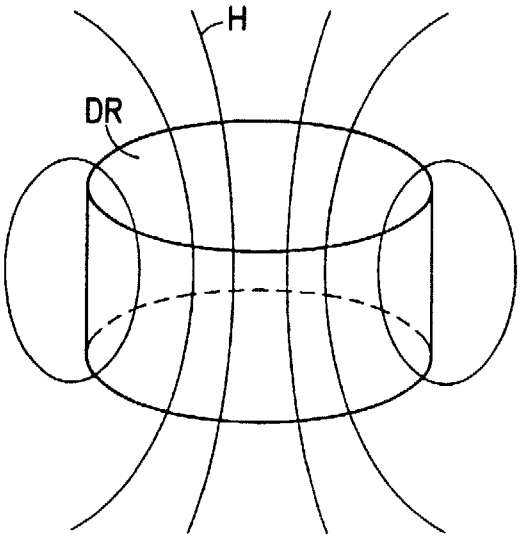
FIG. 14 illustrates a dielectric resonator of a DR filter of the invention, and a magnetic field of the dielectric resonator.

The resonators 1–6 are preferably dielectric resonators and are secured to a bottom wall (not shown) of the housing 36 by a dielectric support (not shown). The resonators 1–6 operate in, for example, a resonate mode $TE_{01\delta}$ that is described in a publication entitled "Dielectric Resonators", by Darko Kajfez and Pierre Guillon (Artech House Inc., Library of Congress 86-70447). Each of the resonators 1–6 exhibits a magnetic field that is similar to the magnetic field (H) of the resonator (DR) shown in FIG. 14. In an exemplary case, for a DR filter having a practically-sized housing, unloaded Q values of 14,000 are observed at 1900 MHz in cellular telephone applications. Also by example, Qu values of about 20,000 are observed at approximately 900 MHz. Presently, DRs are being fabricated of materials that enable the DRs to have extremely stable thermal characteristics similar to those obtained with invar metal resonators. The Qu values of dielectric resonators are substantially greater than those of invar metal resonators.

Each resonator 1–6 is positioned within a cavity 38 of the DR filter 24 at a location that is predetermined to permit an amount of proximity inductive coupling to be provided between adjacent ones of the resonators 1–6 to cause the DR filter 24 to exhibit a frequency response (e.g., a passband bandwidth) and an insertion loss that are in accordance with the requirements of a particular application of interest. Preferably, the filter is symmetrical; that is, the spacing between the resonators 1–3 is the same as that between the resonators 4–6. As can be appreciated, the DR filter 24 can provide the selectivity of a six-resonator filter, and exhibits nulls on both sides of its passband, owing to cross-coupling being provided between the resonators 2 and 5, and a reversed polarity coupling being provided between the resonators 3 and 4. The manner in which the reversed polarity coupling is provided in this invention is through the use of the polarity reversal network 52, as will be described below.

The dimensions and materials of the housing 36, the dielectric resonators 1–6, the walls 44*a* and 44*b*, and the sizes of the irises ($I_1$) and ($I_2$) are also determined in accordance with the insertion loss and frequency response requirements for the filter. It should be noted that the dimensions and/or materials of the filter components required for achieving a desired filter response and insertion loss may be determined in accordance with any suitable technique including, by example, those that are described in any of the following publications: (1) "Dielectric Resonators", by Darko Kajfez and Pierre Guillon (Artech House Inc., Library of Congress 86-70447); (2) "Microwave Filters, Impedance-Matching Networks, and Coupling Structures", by Matthaei, Young, and Jones (McGraw Hill 64-7937); (3) "Very High Frequency Techniques", Vol. 2, Radio Research Laboratory, Harvard University (McGraw-Hill); and (4) "Radio Engineers Handbook" by F. E. Terman, Stanford University (McGraw-Hill).

The polarity reversal network 52 comprises the iris $I_2$ and a cylindrical post or a screw that includes an electrically conductive metal such as, for example, brass. The brass may be silver plated to minimize losses. The screw or post (hereinafter referred to as "the screw 53") protrudes from and is threadedly engaged with a hole (not shown) in wall 63 of the housing, and extends into iris ($I_2$). The screw 53 extends along an axis Z that is normal to the magnetic fields (H) (not shown in FIG. 1) that extend from the resonators 3 and 4. The screw 53 may be adjusted to vary the distance by which the screw 53 extends into the iris ($I_1$).

Upon the screw 53 being initially inserted into the hole in the wall 63, and being adjusted so that an end of the screw 53 begins to penetrate the iris ($I_2$), additional mutual inductive coupling occurs between the resonators 3 and 4 via the screw 53. By adjusting the screw 53 so that it further penetrates the iris ($I_2$), the level of coupling provided by the screw 53 between these resonators 3 and 4 is increased. In this manner, the screw 53 provides a convenient means for adjusting the coupling level provided between the resonators 3 and 4. By further adjusting the screw 53 so that it extends into the iris ($I_2$) by a greater distance, a significant capacitance becomes present between the end of the screw 53 and the end of the wall 44*b*. This capacitance and an inductance of the screw 53 vary as a function of this distance. As the distance is increased such that the capacitance and the screw's inductance approach a same reactance value, the resonant frequency of the screw 53 approaches the filter's passband frequency, and the level of coupling provided via the screw 53 increases significantly. Upon the screw's resonant frequency becoming equal to the filter's passband frequency, the screw 53 behaves as one of the resonators of the DR filter 24 and, as a result, the filter 24 exhibits altered passbands and stopbands.

In accordance with one aspect of the invention, a polarity of a signal being coupled between the resonators 3 and 4 by the screw 53 can be reversed. More particularly, upon the screw 53 being adjusted so that it extends within the iris ($I_2$) by a distance that causes the screw 53 to resonate at a lower frequency than a passband frequency of the DR filter 24, the coupling provided by the screw 53 becomes reduced to an acceptable level. Moreover, a polarity of a signal that is coupled between the resonators 3 and 4 by the screw 53 becomes reversed with respect to the polarity of a signal that is proximity inductively coupled between a pair of the filter's resonators. Thus, the coupled signal has a polarity resembling that of a capacitively-coupled signal (i.e., the coupling provided by the screw 53 resembles capacitive coupling).

It should be noted that the coupling provided by the screw 53 is magnetic. If, for example, the screw 53 were positioned in the DR filter 24 so as to extend along a plane that is parallel to the magnetic fields of the resonators 3 and 4 and orthogonal to the electric fields of these resonators 3 and 4, the screw 53 would have essentially no appreciable effect on the coupling being provided between the resonators 3 and 4.

Figure 12:
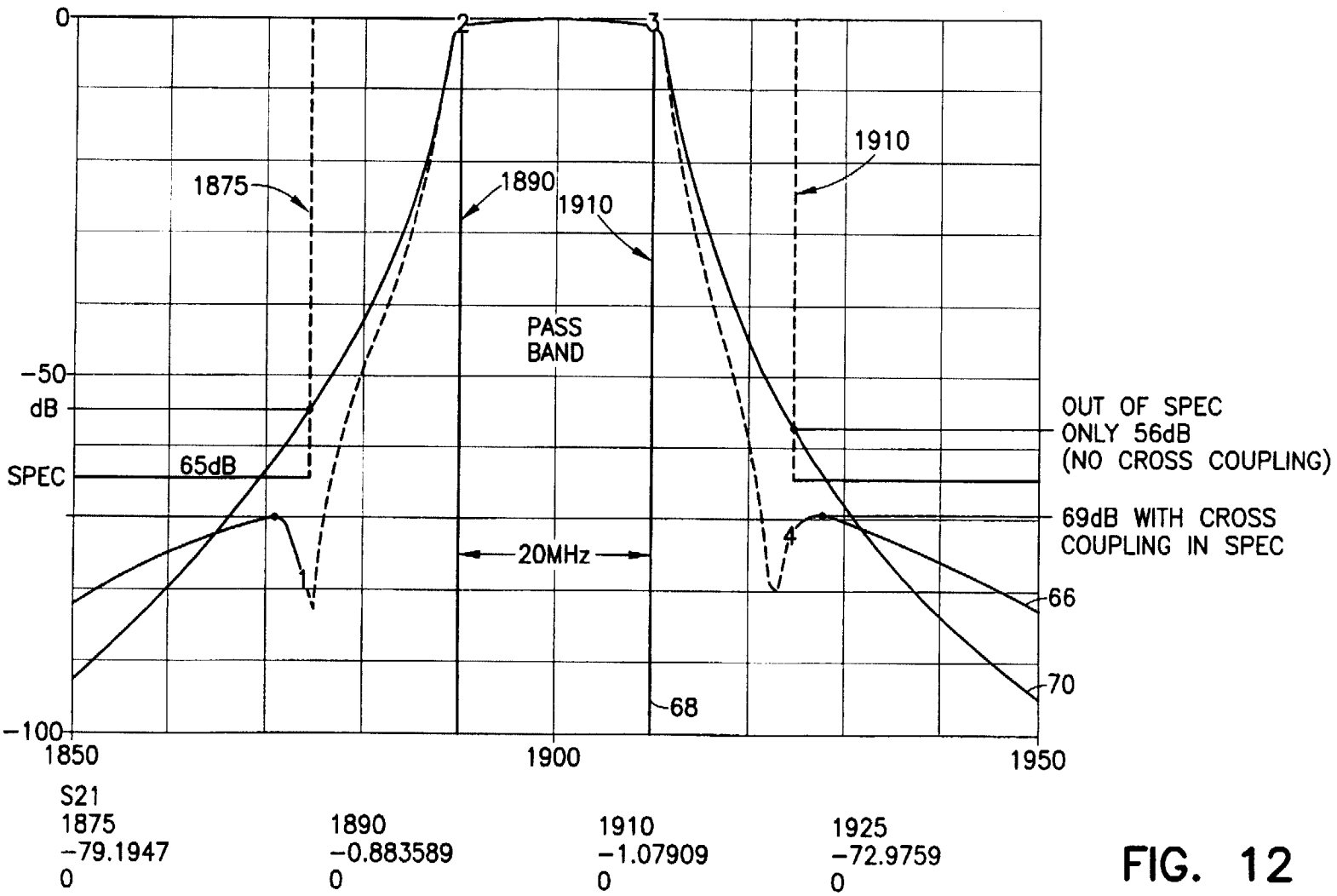
FIG. 12 illustrates a typical frequency response 66 of the DR filter shown in FIG. 1, employing the polarity reversal network and cross coupling, and further shows a frequency response 70 of the DR filter without the cross-coupling.

As described above, upon the screw 53 being tuned to a lower resonant frequency than the passband frequency of the DR filter 24, a polarity of a signal that is coupled between the resonators 3 and 4 becomes reversed. Thus, as can be appreciated, the polarity of the signal coupled between resonators 3 and 4 is reversed with respect to a polarity of a signal being cross-coupled between the resonators 2 and 5. As a result, a cancellation of these signals occurs at stop band frequencies located on opposite sides adjacent to the filter's passband. In an exemplary case in which the DR filter 24 is constructed so that it will exhibit a passband having a bandwidth of 20 MHz, the DR filter 24 exhibits a frequency response that is similar to the curve labelled "66" in FIG. 12. The curve 66 also is a function of the performance of the reactance cancellation circuit 54, which will be described below. The curve labelled "70" in FIG. 12 represents a passband of a filter which is similar to the DR filter 24, but which does not provide cross-coupling between the resonators 2 and 5. The vertical hatched lines labelled "68" in FIG. 12 identify the passband for the DR filter 24. As can be seen, the roll-offs of the response 66 have steeper slopes than those of the response 70 of the filter that does not provide cross-coupling. Also, as can be appreciated, the null frequencies are a function of the amount of coupling provided between the resonators 2 and 5, and between the resonators 3 and 4.

Figure 7A:
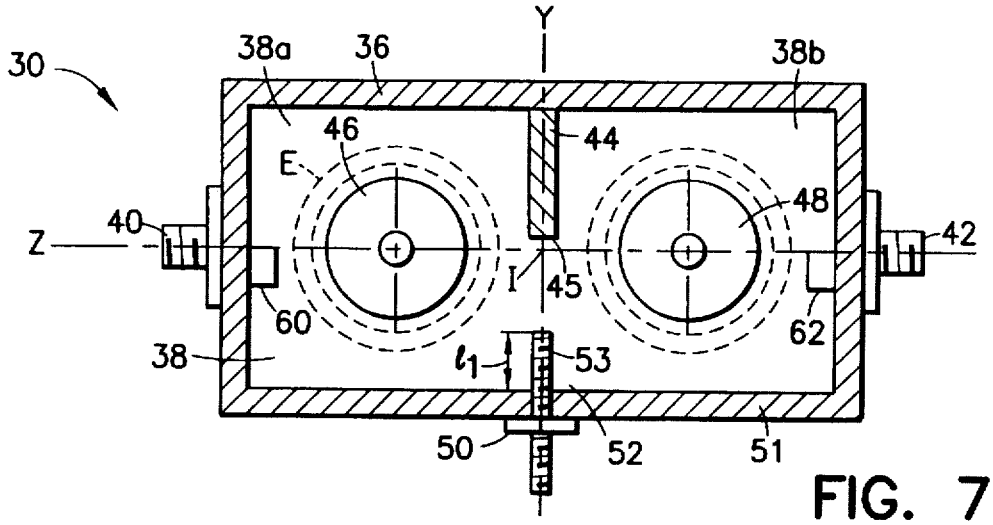
FIG. 7*a* shows a top view of a cross section of a DR filter that is constructed in accordance with the invention having a resonant screw, wherein the resonant screw extends into a cavity of the DR filter by a distance of ($l_1$).
Figure 7B:
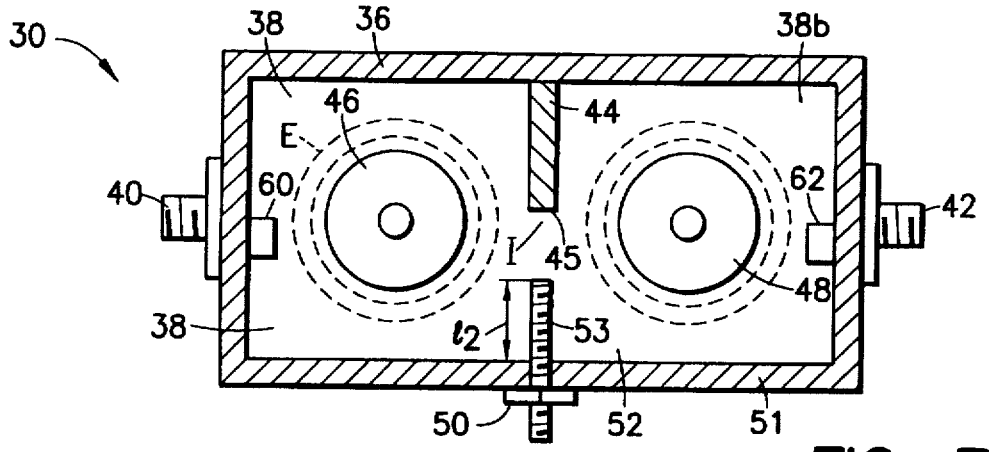
FIG. 7*b* shows a top view of a cross section of a DR filter that is constructed in accordance with the invention having a resonant screw, wherein the resonant screw extends into a cavity of the DR filter by a distance of ($l_2$).
Figure 7C:
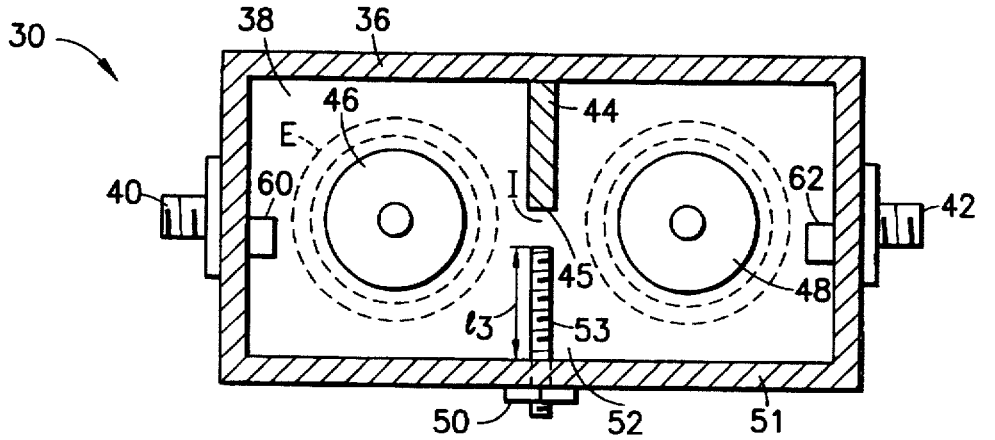
FIG. 7*c* shows a top view of a cross section of a DR filter that is constructed in accordance with the invention having a resonant screw, wherein the resonant screw extends into a cavity of the DR filter by a distance of ($l_3$).

The manner in which the polarity reversal network 52 functions can be further understood in view of FIGS. 7*a*–7*c*. FIG. 7*a* illustrates a cross-section of dielectric resonator (DR) filter 30 having a polarity reversal network 52 that is constructed in accordance with the invention. The DR filter 30 comprises a housing 36, first and second connectors 40 and 42, respectively, couplers 60 and 62, a pair of dielectric resonators 46 and 48, and the polarity reversal network 52. The polarity reversal network 52 comprises a screw or a post 53 and an iris (I). The filter 30 is intended to be exemplary of the manner in which the polarity reversal network 52 enables an equivalent capacitive coupling to occur between resonators. This filter 30 may represent, by example, a portion of a larger DR filter.

The resonator 46 of FIG. 7*a* is centered within a first portion 38*a* of a cavity 38. The resonator 48 is centered within a second portion 38*b* of the cavity 38. The resonators 46 and 48 are separated by a wall 44 and a portion of the screw 53 extending into the cavity 38. The iris (I) is provided between an end 45 of the wall 44 and a distal end of the screw 53 for allowing inductive coupling to occur between the resonators 46 and 48.

The screw 53 protrudes through and is threadedly engaged with a wall 51 of the housing 36, and is kept in place by a nut 50. The screw extends along an axis Y which extends through a center of the iris (I), and which is normal to an axis Z that travels through the center of the resonators 46 and 48, as is shown in FIG. 7*a*. In this manner, a current can be induced into the screw 53 from a magnetic field (H) of the individual resonators 46 and 48, as will be described below. The screw 53 may be rotated in a clockwise or counter-clockwise direction to adjust the length of the portion of the screw 53 that extends into the cavity 38.

The screw 53 introduces an equivalent capacitive coupling between the resonators 46 and 48 in a manner that may be understood in view of the following example. For this example, it is assumed that the portion of the screw extending into the cavity 38 initially has a length of ($l_1$). Currents that are induced into the screw 53 enable the screw 53 to provide inductive magnetic coupling between the resonators 46 and 48 for signals having frequencies that are within the passband of the filter 30. The coupling provided by the screw 53 is in phase with mutual inductive coupling being provided between resonators 46 and 48 via the iris (I). As such, the screw 53 increases the overall level of coupling that is provided between the resonators 46 and 48.

Figure 13C:
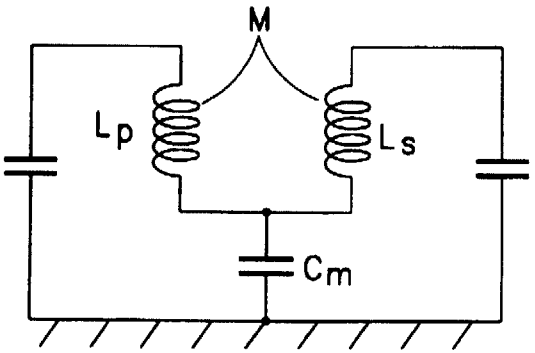
FIG. 13*c* illustrates an equivalent circuit of the DR filter of FIG. 7*c*.
Figure 13A:
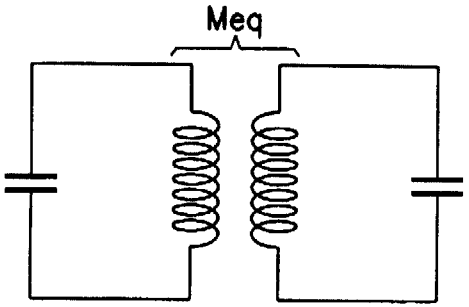
FIG. 13*a* illustrates an exemplary equivalent circuit of a conventional pair of mutually coupled resonant circuits, without a polarity reversal network.
Figure 13B:
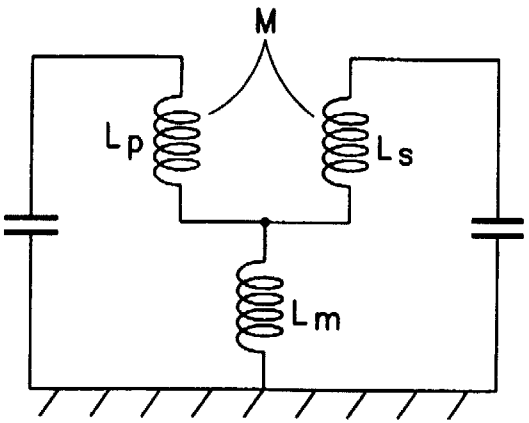
FIG. 13*b* illustrates an equivalent circuit of the DR filter of FIG. 7*a*.

A lumped element equivalent circuit of the configuration of the filter of FIG. 7*a* is shown in FIG. 13*b*. In FIG. 13*b*, inductors (LP) and (LS) represent the equivalent inductances of the resonators 46 and 48, respectively, and the label "M" represents the mutual inductive coupling that occurs via the iris (I) between the resonators 46 and 48. Also in FIG. 13*b*, the inductive coupling provided by the screw 53 is represented by inductor (Lm). FIG. 13*a* shows a lumped element equivalent circuit of the DR filter 30, without the screw 53.

If the screw 53 is adjusted so that it extends into the cavity 38 by a distance which is greater than ($l_1$), and so that an end of the screw 53 becomes closer to end 45 of the wall 44, a significant capacitance becomes present between the end of the screw 53 and the end 45 of the wall 44. This capacitance and the inductance of the screw 53, as well as the resonant frequency of the screw 53, vary as a function of the distance by which the screw 53 extends into cavity 38. As this distance is increased such that the capacitance and the screw's inductance approach a same reactance value, the resonant frequency of the screw 53 approaches the filter's passband frequency, and the level of coupling provided via the screw 53 increases significantly.

Referring to FIG. 7*b*, it is assumed that the screw 53 is adjusted so that it extends into the cavity 38 by a distance of ($l_2$). It is also assumed that, at this distance, the screw's resonant frequency becomes equal to a passband frequency of the DR filter 30. As a result, the screw 53 behaves as one of the resonators of the DR filter 30 and the filter 24 exhibits altered passbands and stopbands.

Referring to FIG. 7*c*, assuming that the screw is further adjusted in a manner so that it extends into the cavity 38 by a distance of ($l_3$), the resonant frequency exhibited by the screw 53 becomes less than the passband frequency of the DR filter 30, and the level of coupling provided by the screw 53 is reduced to an acceptable level. The reactance of the screw 53 becomes negative. Moreover, the coupling provided between the resonators 46 and 48 becomes similar to a capacitive coupling in that it has a reversed polarity with respect to that of typical mutual inductive coupling provided between resonators of dielectric filters. That is, a signal that is coupled between the resonators 46 and 48 via the screw 53 has a polarity resembling that of a capacitively-coupled signal and exhibits a −90° phase shift, whereas a signal that is proximity inductive coupled between adjacent resonators of the filter has +90° phase shift. The reversed polarity coupling provided between the resonators 46 and 48 remains magnetic however.

An equivalent lumped element circuit of the DR filter 30 shown in FIG. 7*c* is shown in FIG. 13*c*. The circuit of FIG. 13*c* is similar to that of FIG. 13*b* except that the inductor $L_m$ is replaced by a capacitor $C_m$.

Referring again the DR filter 24 of FIG. 1, the reactance cancellation circuit 54 of the invention will now be described. The presence of the polarity reversal network 52 in the DR filter 24 can cause the resonant frequencies of the resonators 3 and 4 to be higher than those of the other resonators 1, 2, 5, and 6 of the DR filter 24. As a result, the resonant frequency of the DR filter 24 increases accordingly. This increase is caused by the reactive nature of the coupling provided by the polarity reversal network 52. In an exemplary narrowband filter application, the polarity reversal network 52 can cause the resonant frequencies of the resonators 3 and 4 to be increased by approximately 0.2% to 0.3%. Thus, tuning is required to compensate for this increase in resonant frequency. Conventionally, such tuning has been provided using, for example, tuning screws. As is well known to those who are skilled in the art, dielectric resonator filters in general are tuned over a small frequency range to maintain a high value of the filter's unloaded Q (i.e., to minimize the filter's insertion loss) and to retain thermal stability characteristics of the resonators. Thus, it is desirable that the dielectric filters be tuned over a small, limited frequency range. One technique for tuning the DR filter 24 to compensate for the increase in its resonant frequency due to the presence of the polarity reversal network 52 involves increasing the size of the resonators 3 and 4 that are adjacent to the polarity reversal network 52. However, this can make manufacturing of DR filters more difficult and expensive than usual since the technique requires the DR filters to be fabricated to include resonators of different sizes.

Figure 15:
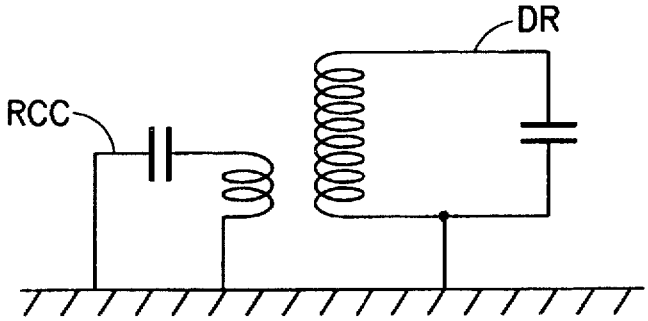
FIG. 15 illustrates an equivalent circuit of a reactance cancellation circuit (RCC) of the invention that is magnetically coupled to an equivalent circuit of a dielectric resonator (DR) of the invention.

Thus, in accordance with another aspect of the invention, the reactance cancellation circuit 54 is provided to compensate for the increase in the resonant frequencies of the resonators 3 and 4 resulting from the presence of the polarity reversal network 52. This aspect of the invention may be understood in view of FIG. 15 and the DR filter 31 shown in FIG. 8. Referring first to FIG. 15, an equivalent resonant circuit of the reactive cancellation circuit 54 is shown, and is referenced by label "RCC". The equivalent circuit RCC is shown to be adjacent to an equivalent circuit of the resonator (DR). The circuit RCC enables a small amount of mutual inductance to be provided between the circuit RCC and the equivalent circuit of the resonator (DR), and causes a reactance to be induced into the resonator (DR). When the reactance cancellation circuit is employed in a DR filter, this reactance offsets the reactance caused by the polarity reversal network 52.

Figure 8:
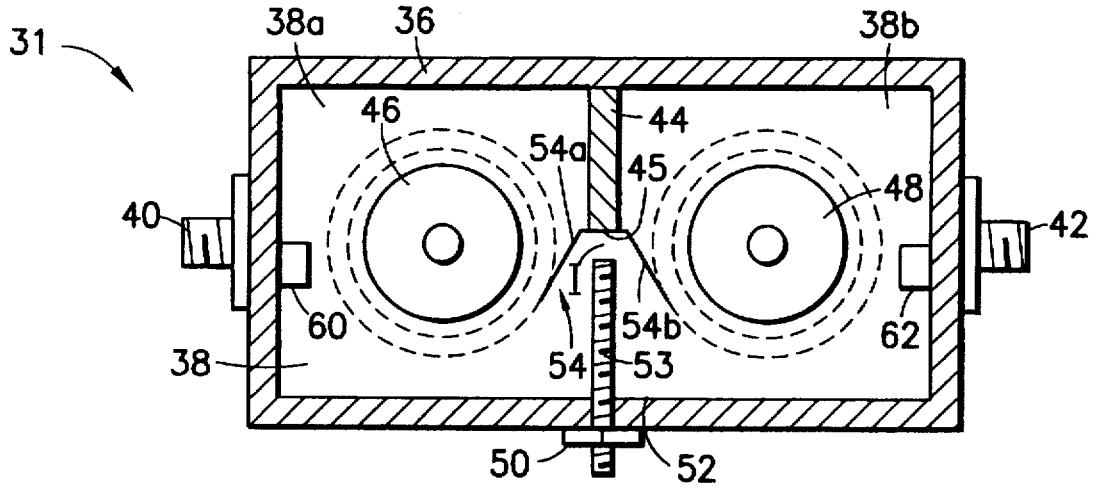
FIG. 8 shows the DR filter of FIG. 7, further including a reactance cancellation circuit that is constructed in accordance with the invention.
Figure 16:
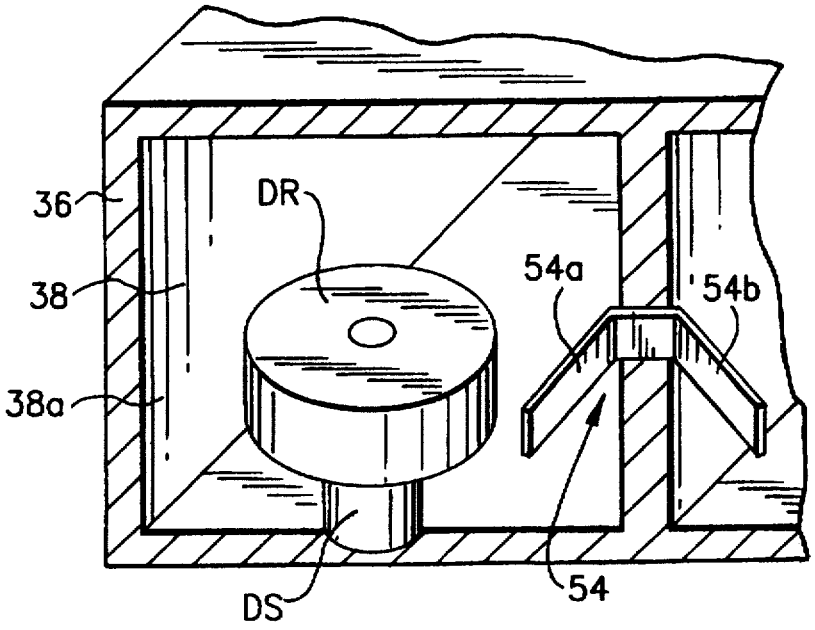
FIG. 16 illustrates a side view of a cross section of a reactance cancellation circuit that is constructed in accordance with the invention, and which is positioned adjacent to a dielectric resonator.

FIG. 8 shows a DR filter 31 that is similar to the DR filter 30 of FIG. 7*c*, except that the DR filter 31 of FIG. 8 includes a reactance cancellation circuit 54. The reactance cancellation circuit 54 includes two strips 54*a* and 54*b* which are attached and grounded at the end surface 45 of the wall 44 so that the strips 54*a* and 54*b* (FIG. 8) collectively form an upside-down V-shaped device that extends from the end surface 45 into respective portions 38*a* and 38*b* of the cavity 38. Each strip 54*a* and 54*b* is located adjacent to a respective resonator 46 and 48, and is spaced apart from the respective resonator by a suitable distance. The reactance cancellation circuit 54 may be secured to the wall 44 by any suitable means, so long as the strips 54*a* and 54*b* form a V-shape as is shown in FIG. 8. FIG. 16 illustrates a front view perspective of the reactance cancellation circuit 54, including the strips 54*a* and 54*b*. The strip 54*b* extends into cavity portion 38*a* within which a resonator (DR) is situated. The resonator (DR) is mounted on a dielectric support (DS) secured to a bottom wall of housing 36. The reactance cancellation circuit 54 may be comprised of any suitable electrically-conductive materials such as, by example, silver-plated brass, aluminum, or copper.

The reactance cancellation circuit 54 provides the DR filter 31 with an additional reactive component which offsets the reactance of the screw 53. As a result, the effect of the screw 53 in increasing the resonant frequency of the DR filter 31 is minimized. It should be noted that because the reactance cancellation circuit 54 is comprised of two independent strips 54*a* and 54*b* that are each grounded at the end surface 45 of the wall 44, the circuit 54 does not contribute to the overall coupling that is provided between the resonators 46 and 48. That is, each strip 54*a* and 54*b* is not mutually coupled to both of the resonators 46 and 48.

Figure 10:
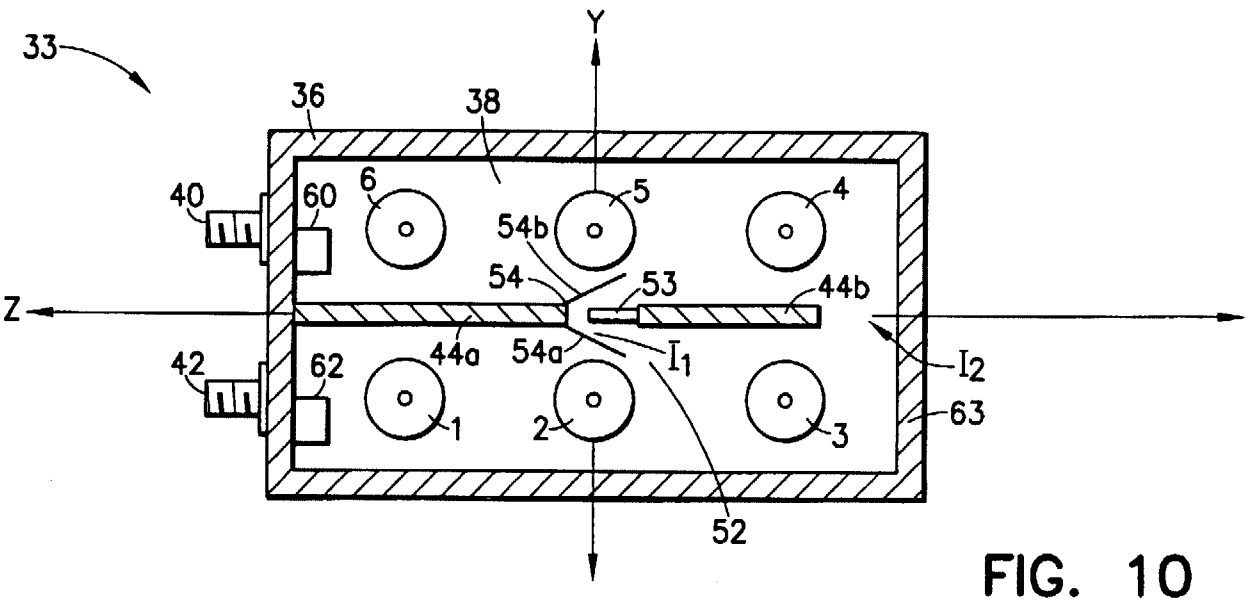
FIG. 10 shows a top view of a cross section of a DR filter that is constructed in accordance with a further embodiment of the invention.

Further embodiments of the invention will now be described. The polarity reversal network 52 may provide an equivalent capacitive coupling between any two adjacent resonators of the DR filters of the invention. When the polarity reversal network 52 is employed to provide such coupling between two resonators that are located within a portion of a specific filter path, the filter provides stopband nulls. Referring to FIG. 10, for example, a DR filter 33 is shown that is constructed in accordance with an embodiment of the invention. The DR filter 33 comprises a housing 36, first and second walls 44*a* and 44*b*, respectively, first and second connectors 40 and 42, respectively, dielectric resonators 1–6, couplers 60 and 62, a polarity reversal network 52, and a reactance cancellation circuit 54. The resonators 1–6 are similar to those described above. The first and second walls 44*a* and 44*b* are separated from one another at respective adjacent ends thereof by an iris ($I_1$). The dimensions and materials of the components of the DR filter 33 are selected in accordance with the insertion loss and passband requirements for a particular application of interest, in a similar manner as was described above.

The reactance cancellation circuit 54 is similar to that described above, but is attached and grounded to an end of the wall 44*a* that is at the iris ($I_1$) so that the strips 54*a* and 54*b* extend into the iris ($I_1$) and are separated from the resonators 2 and 5, respectively, by suitable distances.

In this embodiment of the invention, the polarity reversal network 52 is located between the resonators 2 and 5 and comprises the iris ($I_1$) and a screw or post 53. The screw 53 protrudes from and is threadedly engaged with an end of wall 44*b* that is at the iris ($I_1$). An end of the screw extends into a center of the iris ($I_1$) in a direction that is normal to a surface of this end of the wall 44*b*. The screw 53 and the walls 44*a* and 44*b* extend along an axis Z that is normal to an axis Y which travels through centers of the resonators 2 and 5. In this manner, a current is able to be induced into the screw 53 by a magnetic field (not shown in FIG. 10) of the individual resonators 2 and 5. The screw 53 may be adjusted to vary the distance by which the screw 53 extends into the iris ($I_1$), and to enable the polarity reversal network 52 to provide a reversed polarity coupling between the resonators 2 and 5, in a similar manner as was described above.

As can be appreciated, because the polarity reversal network 52 is located between the resonators 2 and 5, the filter 33 can exhibit stopband nulls when the screw 53 is tuned so as to provide a reversed-polarity (i.e., an equivalent capacitive) coupling between these resonators 2 and 5. As can also be appreciated, the polarity reversal network 52 may be located so as to provide an equivalent capacitive coupling between other resonators of the DR filter 33 to enable the filter 30 to exhibit stopband nulls. By example, the polarity reversal network 52 may be employed between either resonators 2 and 3, between resonators 3 and 4, or between resonators 4 and 5, instead of between the resonators 2 and 5.

Figure 11:
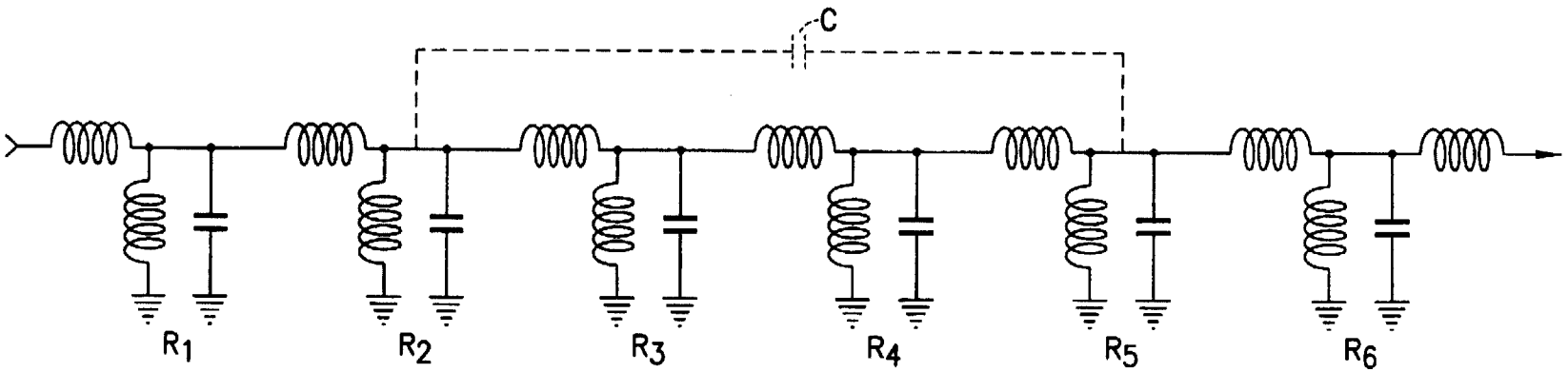
FIG. 11 illustrates an example of an equivalent lumped element circuit of the DR filter of FIG. 10.

An equivalent lumped element circuit of the DR filter 33 is shown in FIG. 11. A cross coupling capacitor (C) is provided between portions of the circuit representing the resonators 2 and 5. The resonators 1–6 correspond to the portions of the circuit labelled "R1–R6", respectively.

Figure 3:
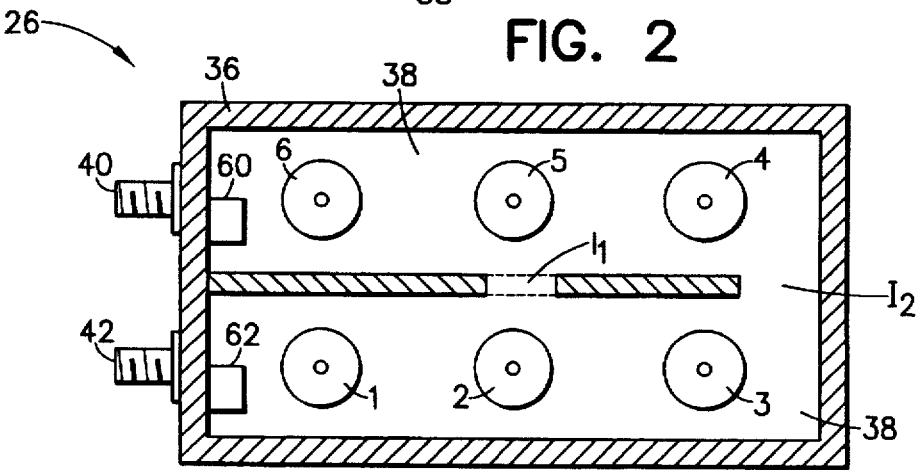
FIG. 3 PRIOR ART
FIG. 3 shows a top view of a cross section of an exemplary DR filter that is constructed in accordance with the prior art.
Figure 4:
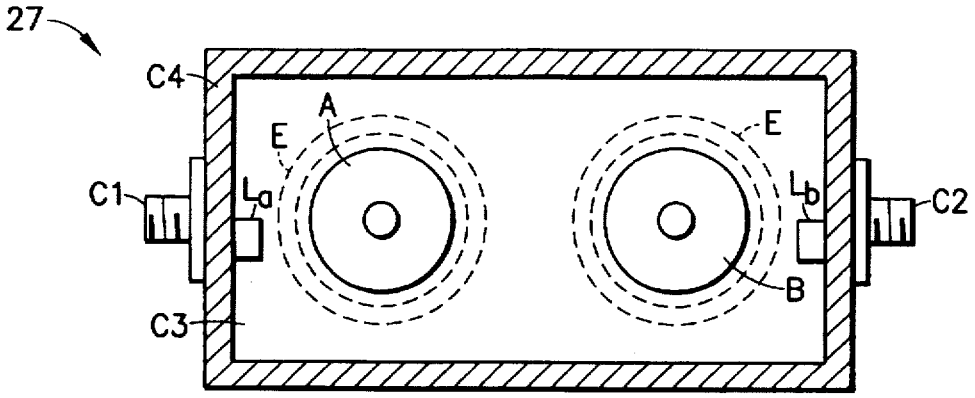
FIG. 4 PRIOR ART
FIG. 4 is an illustration of the prior art showing an example of proximity inductive coupling occurring between two adjacent dielectric resonators of a conventional DR filter.
Figure 5:
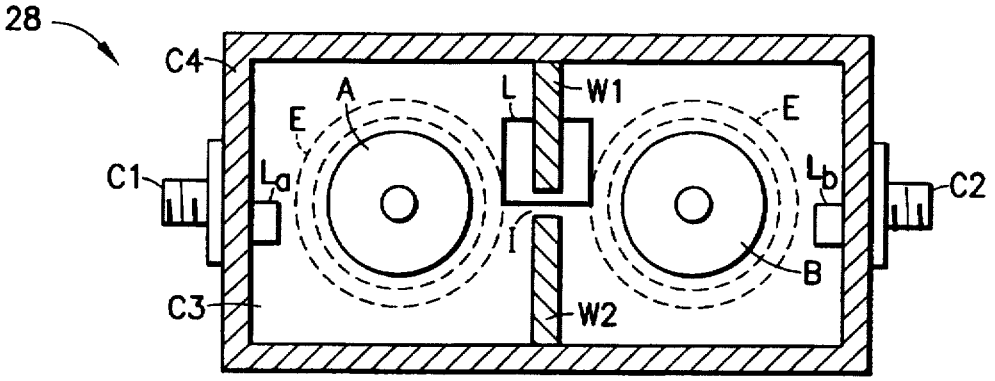
FIG. 5 PRIOR ART
FIG. 5 illustrates a top view of a cross section of a prior art DR filter that includes an iris located between a pair of resonators, and a wire loop for providing magnetic coupling between the resonators.
Figure 6:
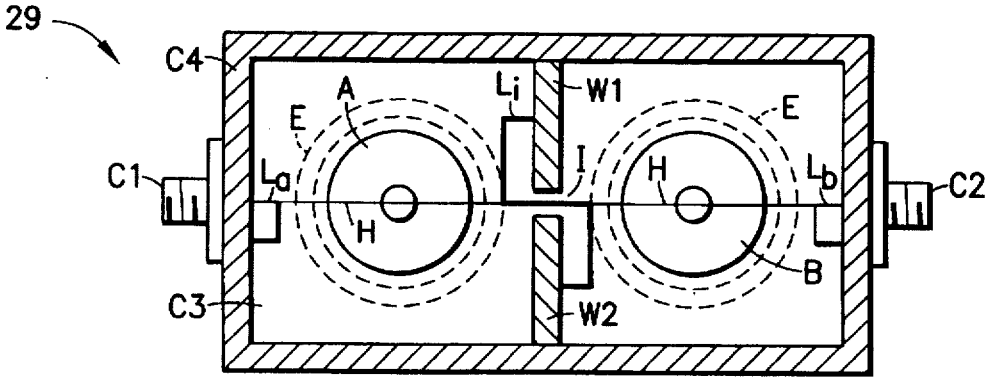
FIG. 6 PRIOR ART
FIG. 6 illustrates a top view of a cross section of a prior art DR filter that includes an iris located between a pair of dielectric resonators, and a wire loop for providing a reversed-phase magnetic coupling between the resonators.

FIG. 3 shows a DR filter 26 that is similar to the DR filter 33 of FIG. 10, except that the DR filter 26 of FIG. 3 does not include the polarity reversal network 52 or the reactance cancellation circuit 54. As can be appreciated, because this device does not include the polarity reversal network 52, no reversed-polarity coupling is provided within the filter. Thus, stopband nulls are not provided by the filter 26, and the filter's response is degraded due to cross-coupling provided between resonators 2 and 5.

For another example of the use of the polarity reversal network 52 for enabling a filter to produce stopband nulls, reference is again made to the DR filter 24 of FIG. 1. When a signal is applied to the connector 42 of the DR filter 24, it is coupled through the coupler 62 to a primary path of the filter 24 that includes the resonators 1, 2, 3, 4, 5, and 6, and then to the connector 40 via coupler 60. At least a portion of the signal that is applied to the connector 42 is also coupled to a secondary path of the filter that includes the resonator 1, cross-coupled resonators 2 and 5, and the resonator 6. Thereafter, the signal is coupled to connector 40 via the coupler 60. Upon adjusting the screw 53 in the manner described above to cause the screw's resonant frequency to fall below the passband frequency of the filter 24, an equivalent capacitive coupling is provided between the resonators 3 and 4. As a result, the signal traversing the primary path exhibits a reversed polarity with respect to that of the signal traversing the secondary path, and a cancellation of these signals results, thereby providing a stopband null. The null frequencies exhibited by the DR filter 24 are a function of the magnitude of cross-coupling that is provided between the resonators 2 and 5. The DR filter 24 has a passband with steeper skirts than, for example, a similar filter which does not provide cross-coupling.

As can be appreciated, the polarity reversal network 52 of the DR filter 24 may be located so as to provide an equivalent capacitive coupling between other resonators of the filter 24 to enable the filter 30 to exhibit stopband nulls. By example, the polarity reversal network 52 may be employed between either resonators 2 and 3, between resonators 4 and 5, or between the resonators 2 and 5, instead of between the resonators 3 and 4.

Figure 2:
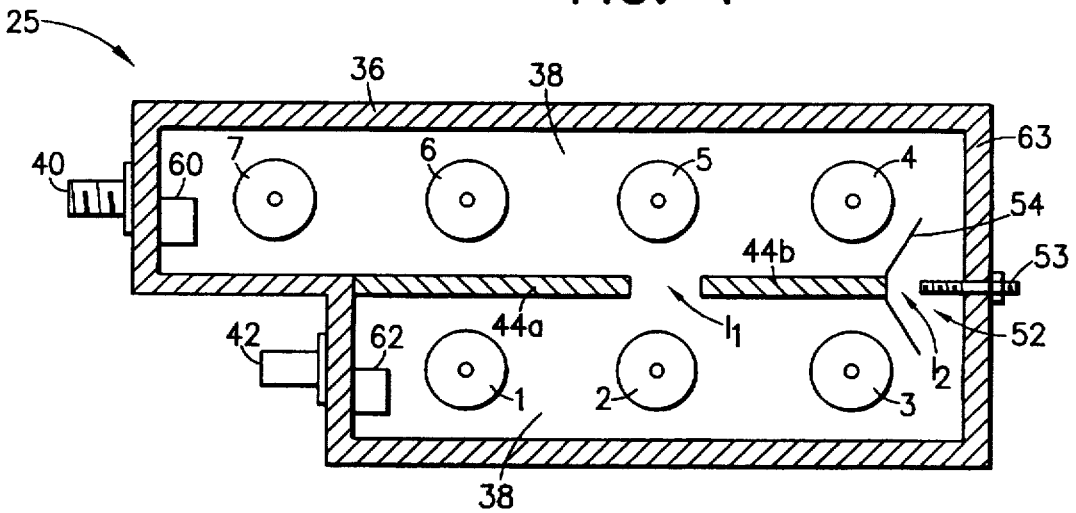
FIG. 2 illustrates a top view of a cross section of a DR filter that includes seven dielectric resonators, a polarity reversal network, and a reactance cancellation circuit constructed in accordance with the invention.

FIG. 2 illustrates another embodiment of the invention, namely a DR filter 25. The components of the DR filter 25 of FIG. 2 are similar to those of the DR filter 24 of FIG. 1, except that the DR filter 25 of FIG. 2 includes an additional dielectric resonator 7. Also, the housing 36 is shaped to include the resonator 7 within the cavity 38. The resonators 1–7 are preferably positioned within the cavity 38 in a similar manner as was described above so that a sufficient degree of coupling occurs between adjacent ones of the resonators 1–7 to enable the DR filter 25 to exhibit an insertion loss and a frequency response that are in accordance with requirements for a particular application of interest.

The polarity reversal network 52 and the reactance cancellation circuit 54 function in a similar manner as described above. As for the DR filter 24 of FIG. 1, the polarity reversal network 52 of the DR filter 25 of FIG. 2 may also be employed to provide an equivalent capacitive coupling between either the resonators 2 and 3, between the resonators 4 and 5, or between the resonators 2 and 5, instead of between the resonators 3 and 4. As can be appreciated by those with skill in the art, the DR filter 25 exhibits a passband response which has nulls on both side of the filter's passband. The inclusion of the resonator 7 within the DR filter 25 does not affect the frequencies of these nulls. However, the inclusion of the resonator 7 within the DR filter 25 enables the filter 25 to exhibit greater selectivity than, for example, the DR filter 24 of FIG. 1.

Figure 9:
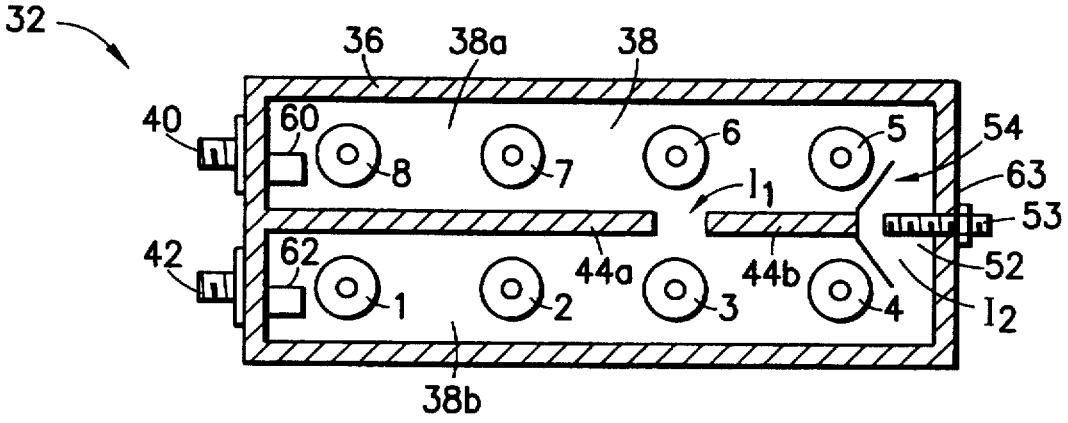
FIG. 9 illustrates a top view of a cross section of a DR filter that is constructed in accordance with a further embodiment of the invention.

A further embodiment of the invention is illustrated in FIG. 9. In FIG. 9, a cross section of a DR filter 32 is shown which is similar to that of FIG. 2, except that the DR filter 32 also includes a resonator 8, and the housing 36 of the DR filter 32 is shaped so that the resonator 8 is included within the cavity 38. Inductive cross-coupling is provided between resonators 3 and 6 via iris ($I_1$). The reactance cancellation circuit 54 functions in a similar manner as described above. Also, the polarity reversal network 52 provides an equivalent capacitive coupling between the resonators 4 and 5 in a similar manner as was described above. The equivalent capacitive coupling provided by the polarity reversal network 52 and the inductive coupling provided between the resonators 3 and 6 enable the DR filter 32 to exhibit stopband nulls on both sides of the filter's passband. As can be appreciated by those skilled in the art, the use of eight resonators within the filter 32 enables the filter 32 to have a greater selectivity than a similar filter that includes fewer resonators.

It should be noted that the polarity reversal network may also be employed in other types of DR filters in addition to those described above. For example, the polarity reversal network 52 may be employed in DR filters that are constructed to produce nulls on only one side of the filter's passband. In these filters, the polarity reversal network 52 can be positioned between a selected pair of resonators of a filter path that enables the filter to produce a null.

Figure 17A:
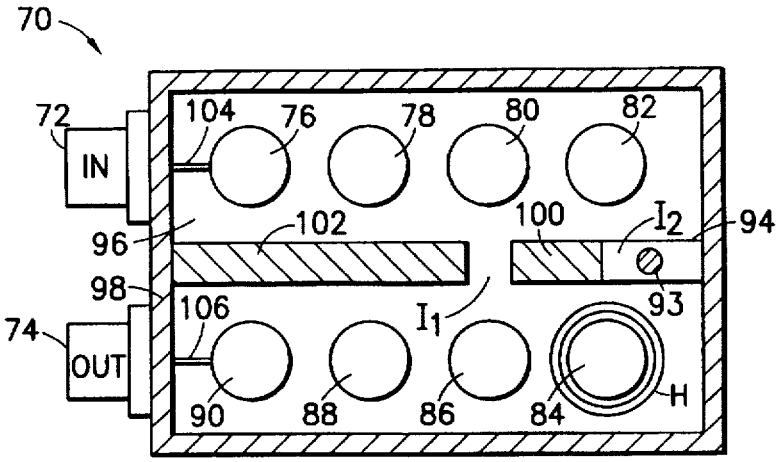
FIG. 17*a* illustrates a top view of a cross section of a combline filter that includes a polarity reversal network constructed in accordance with the invention.
Figure 17B:
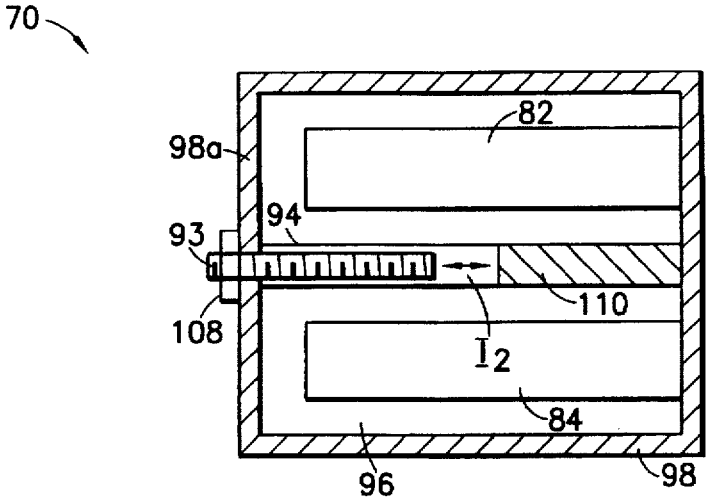
FIG. 17*b* illustrates a cross section of the combline filter of FIG. 17*a*, as viewed from a perspective looking down on a side of the combline filter.
Figure 17C:
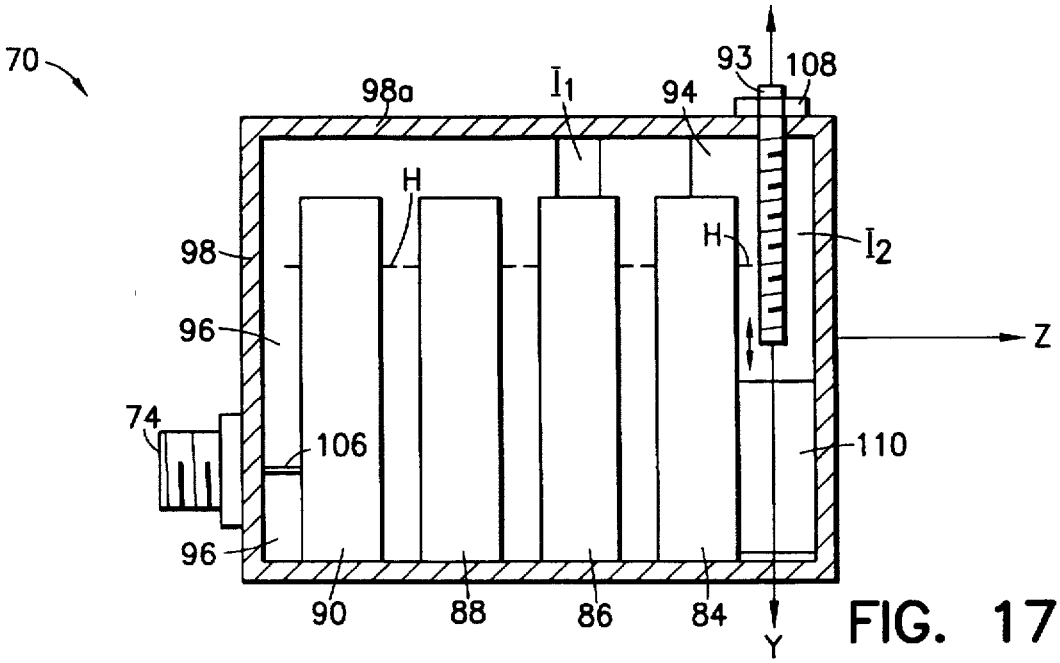
FIG. 17*c* illustrates a cross section of the combline filter of FIG. 17*a*, as viewed from a perspective looking down on a front side of the combline filter.

In accordance with another aspect of the invention, the polarity reversal network is provided within a combline filter. A combline filter 70 having a polarity reversal network 94 is shown in FIGS. 17*a*–17*c*. The combline filter 70 includes a housing 98, a plurality of combline resonators 76–90, walls 100, 102 and 110, irises ($I_1$) and ($I_2$), a cavity 96, first and second connectors 72 and 74, respectively, and couplers 104 and 106. The dimensions and materials of these components may be selected in accordance with any suitable technique to enable the combline filter 70 to exhibit a frequency response and an insertion loss that are in accordance with performance requirements for a particular application of interest.

Similarly, the resonators 76–90, which may comprise any suitable metal, are situated in the cavity 96 with respect to one another in a manner that allows a sufficient degree of inductive coupling to be provided between adjacent resonators for enabling the filter 70 to exhibit a desired passband bandwidth.

Combline resonators yield magnetic fields (H) that extend around the resonators in a plane that is perpendicular to an axis Y, as is shown in FIG. 17*c*. Also, coupling that is provided between combline resonators of combline filters is primarily magnetic. These characteristics of combline filters are known in the art.

The polarity reversal network 94 includes the iris ($I_2$) and a screw or post 93 (hereinafter referred to as a "screw 93"). The screw 93 extends through a top wall 98*a* of the housing 98 along axis Y that is centered within the iris ($I_2$), and which is normal to a plane in which the magnetic fields (H) of the resonators 82 and 86 appear, as was described above. The screw 93 is held in place by a nut 108. The distance by which the screw 93 extends into the iris ($I_2$) along the Y axis can be adjusted in a similar manner as was described above. After a signal is input into the combline filter 70 via the connector 72, the signal is inductively coupled throughout a primary and a secondary path of the filter 70. The primary path includes the resonators 76–90 and the iris ($I_2$), and the secondary path includes the resonators 76–80 and 86–90 and the iris ($I_1$). Inductive cross-coupling is provided between the resonators 80 and 86 via the iris ($I_1$).

By adjusting the screw 93 in the manner described above so that the screw 93 exhibits a resonant frequency that is lower than the passband frequency of the combline filter 70, the polarity reversal network 94 is caused to provide an equivalent capacitive coupling between the resonators 82 and 84 in a similar manner as was described above. That is, a signal that is coupled between the resonators 82 and 84 via the screw 93 has a polarity resembling that of a capacitively-coupled signal and exhibits a −90° phase shift, whereas a signal that is proximity inductive coupled between adjacent resonators of the filter has +90° phase shift. As a result of the equivalent capacitive coupling, and the inductive cross-coupling being provided between resonators 80 and 86, the combline filter 70 is able to exhibit nulls on both sides of its passband. Also, the combline filter 70 exhibits a passband having steep skirt slopes.

It should be noted that the polarity reversal network 94 may be employed between other resonators of the filter to enable the filter to exhibit stopband nulls. By example, the polarity reversal network 94 may also be employed between the resonators 84 and 86, between the resonators 80 and 82, or between the resonators 80 and 86.

It should also be noted that the polarity reversal network of the invention may also be employed to provide an equivalent capacitive coupling between resonators of other types of combline filters that include various numbers of resonators. Within these other combline filters, the polarity reversal network may be located within the filters so as to enable the filters to exhibit stopband nulls in the manner described above.

While the invention has been particularly shown and described with respect to preferred embodiments thereof, it will be understood by those skilled in the art that changes in form and details may be made therein without departing from the scope and spirit of the invention. By example, the precise locations of the screw within the irises may be determined in accordance with the filter performance characteristics required for a particular application. Furthermore, the polarity reversal network may be employed in other suitable devices besides the filters described above, and the filters may comprise more or less than the numbers of resonators described above.

What is claimed is:

1. A polarity reversal network for a microwave filter, said microwave filter including a plurality of resonators, said network comprising:

coupling means, at least a portion of said coupling means extending within an iris of said microwave filter between a pair of said resonators, said coupling means having a resonant frequency tuned below a passband frequency of said microwave filter, said coupling means inductively coupling a signal from a first one of said pair of resonators to a second one of said pair of resonators, and reversing a polarity of said signal to a polarity which resembles that of a capacitively-coupled signal.

2. A polarity reversal network as set forth in claim 1, wherein said signal exhibits a −900° phase shift after it is inductively coupled by said coupling means.

3. A polarity reversal network as set forth in claim 1, wherein said coupling means comprises a screw, wherein a portion of said screw extends within said iris in a direction that is normal to a plane in which magnetic fields of said first and second resonators appear, and wherein said screw is magnetically coupled to said magnetic fields.

4. A polarity reversal network as set forth in claim 3, wherein said screw extends into said iris by a distance which is variable, and wherein said resonant frequency is a function of said distance.

5. A polarity reversal network as set forth in claim 1, wherein each of said resonators is comprised of a dielectric resonator.

6. A filter, said filter including an input, an output, and at least two paths, each of said paths being connected between said input and said output and comprising a plurality of inductively coupled resonators, said filter further comprising:

coupling means, said coupling means being tunable to vary a resonant frequency of said coupling means, at least a portion of said coupling means extending within an iris of said filter between a pair of the inductively coupled resonators of one of said paths, said coupling means coupling a signal between said pair of the inductively coupled resonators and reversing a polarity of said signal upon said coupling means being tuned to a resonant frequency that is lower than a frequency of a passband of said filter.

7. A filter as set forth in claim 6, wherein each of said plurality of inductively coupled resonators is comprised of a dielectric resonator.

8. A filter as set forth in claim 6, further comprising means for offsetting a reactance of said coupling means to minimize an effect of said reactance on a resonant frequency of said filter.

9. A filter as set forth in claim 8, wherein said offsetting means includes a reactance cancellation circuit having a V-shape.

10. A method for coupling a signal from a first resonator of a microwave filter to a second resonator of said microwave filter and for reversing a polarity of the signal, each resonator yielding a respective magnetic field, said filter having a characteristic passband, comprising the steps of:

positioning a coupling means within an iris of said filter between said first and second resonators so that said signal becomes magnetically coupled from said first resonator to said second resonator via said coupling means, said coupling means being tunable to adjust a resonant frequency of said coupling means; and tuning said coupling means to a frequency that is lower than a passband frequency of said filter to reverse a polarity of said signal.

11. A method as set forth in claim 10, wherein, in the positioning step, there is a positioning of said coupling means to extend along an axis that is normal to a plane in which each of said magnetic fields appear.

12. A method for producing at least one stopband null for a microwave filter, said microwave filter having a plurality of paths, each of said paths being connected between an input and an output of said filter, each of said paths including a plurality of resonators for inductively coupling a signal between resonators along the path, a first pair of resonators of a first one of said paths being cross-coupled, said microwave filter having a characteristic passband frequency, the method comprising the steps of:

positioning a coupling means within an iris of said filter between either said first pair of resonators or between a second pair of resonators of said second path so that said coupling means magnetically couples a signal between either said first pair of resonators or said second pair of resonators, said coupling means being tunable to adjust a resonant frequency of said coupling means; and tuning said coupling means to a resonant frequency that is lower than said passband frequency of said filter to reverse a polarity of said signal.

13. A polarity reversal network for a microwave filter, said microwave filter including a plurality of inductively coupled resonators, said network comprising:

coupling means, at least a portion of said coupling means extending within an iris of said microwave filter between a pair of said resonators, said coupling means being tunable to adjust a resonant frequency of said coupling means, said coupling means coupling a signal from a first one of said pair of resonators to a second one of said pair of resonators, and reversing a polarity of said signal with respect to a signal being inductively coupled between another pair of said resonators upon said coupling means being tuned to have a resonant frequency that is lower than a passband frequency of the microwave filter.

14. A polarity reversal network as set forth in claim 13, wherein said coupling means comprises a screw, wherein at least a portion of said screw extends within said iris of said microwave filter in a direction that is normal to a plane in which magnetic fields of said first and second resonators appear, and wherein said screw is magnetically coupled to said magnetic fields.

15. A polarity reversal network as set forth in claim 14, wherein said screw extends into said iris by a distance which is variable, and wherein said resonant frequency is a function of said distance.

16. A polarity reversal network as set forth in claim 13, wherein each of said resonators is comprised of a dielectric resonator.

17. A polarity reversal network as set forth in claim 1, wherein each of said resonators is comprised of a combline resonator.

18. A filter as set forth in claim 6, wherein each of said plurality of inductively coupled resonators is comprised of a combline resonator.

19. A polarity reversal network as set forth in claim 13, wherein each of said resonators is comprised of a combline resonator.

20. A filter as set forth in claim 6, wherein upon said coupling means reversing the polarity of said signal, said filter exhibits nulls on opposite sides of the passband.

21. A microwave filter, comprising:

a housing, said housing including an input, an output, and at least two inner partitions, a first one of said partitions having a first end connected to a first, inner wall of said housing and a second end disposed in an inner cavity area of said housing, a second one of said partitions being disposed within said inner cavity area and having a first end disposed adjacent to, and separated from, said second end of said first partition so as to define a first iris between said second end of said first partition and said first end of said second partition, said second partition also having a second end separated from a second inner wall of said housing for defining a second iris therebetween, said second inner wall opposing said first inner wall, said first and second partitions dividing said inner cavity area and defining first and second cavities within said housing, said first cavity being coupled to said input, said second cavity being coupled to said output;

a first plurality of resonators disposed within said first cavity;

a second plurality of resonators disposed within said second cavity, wherein first resonators from respective ones of said first and second plurality of resonators are cross coupled through said first iris, and second resonators from respective ones of said first and second plurality of resonators are coupled through said second iris, said first and second plurality of resonators defining at least one path by which signals flow from said input to said output; and coupling means having a tunable resonant frequency, at least a portion of said coupling means extending through said second inner wall and into said second iris between said second resonators of respective ones of said first and second plurality of resonators for coupling a signal between these resonators and interacting with said second iris to reverse a polarity of said signal upon said coupling means being tuned to a resonant frequency lower than a passband frequency of said microwave filter, thereby causing said microwave filter to yield stopband nulls on opposite sides of the passband.

22. A microwave filter as set forth in claim 21, wherein each of said resonators includes a dielectric resonator.

23. A microwave filter as set forth in claim 21, wherein each of said resonators includes a combline resonator.

24. A microwave filter as set forth in claim 21, wherein each of said first and second plurality of resonators includes three resonators.

25. A microwave filter as set forth in claim 21, wherein each of said first and second plurality of resonators includes four resonators.

26. A microwave filter as set forth in claim 21, wherein said first plurality of resonators includes three resonators, and wherein said second plurality of resonators includes four resonators.

27. A microwave filter as set forth in claim 21, wherein said first plurality of resonators are disposed in said first cavity in a configuration that is symmetrical to a configuration in which said second plurality of resonators are disposed within said second cavity.

28. A microwave filter, comprising:

a housing, said housing including an input, an output, and at least two inner partitions, a first one of said partitions having a first end connected to a first, inner wall of said housing and a second end disposed in an inner cavity area of said housing, a second one of said partitions being disposed within said inner cavity area and having a first end disposed adjacent to, and separated from, said second end of said first partition so as to define a first iris between said second end of said first partition and said first end of said second partition, said second partition also having a second end separated from a second inner wall of said housing for defining a second iris therebetween, said second inner wall opposing said first inner wall, said first and second partitions dividing said inner cavity area and defining first and second cavities within said housing, said first cavity being coupled to said input, said second cavity being coupled to said output;

a first plurality of resonators disposed within said first cavity;

a second plurality of resonators disposed within said second cavity, wherein first resonators from respective ones of said first and second plurality of resonators are coupled together through said first iris, and second resonators from respective ones of said first and second plurality of resonators are coupled together through said second iris, said first and second plurality of resonators defining at least one path by which signals flow from said input to said output; and coupling means having a tunable resonant frequency, at least a portion of said coupling means extending from said first end of said second partition into said first iris for coupling a signal between said first resonators of respective ones of said first and second plurality of resonators and reversing a polarity of said signal upon said coupling means being tuned to a resonant frequency lower than a passband frequency of said microwave filter, thereby causing said microwave filter to yield stopband nulls on opposite sides of the passband.

* * * * *